US006425755B1

(12) United States Patent
Pillard et al.

(10) Patent No.: US 6,425,755 B1
(45) Date of Patent: Jul. 30, 2002

(54) LIQUID FUEL BURNER AND ATOMIZER HAVING LOW EMISSIONS OF $NO_X$ AND DUST

(75) Inventors: Jean-Claude Pillard, Marseilles; Jacques Pizant, Allauch, both of (FR)

(73) Assignee: Enterprise Generale de Chauffage Industriel Pillard, Marseilles (FR)

( * ) Notice: Subject to any disclaimer, the term of this patent is extended or adjusted under 35 U.S.C. 154(b) by 0 days.

(21) Appl. No.: 09/583,253

(22) Filed: May 31, 2000

(30) Foreign Application Priority Data

May 31, 1999 (FR) ..... 99 07030

(51) Int. Cl.[7] ..... F23D 11/00; B05B 1/00

(52) U.S. Cl. ..... 431/159; 431/187; 431/182; 431/154; 239/554; 239/596; 239/600

(58) Field of Search ..... 431/159, 181, 431/187, 182, 186, 189, 164, 174, 154, 13, 17, 354, 350; 239/398, 554, 600, 596, 125

(56) References Cited

U.S. PATENT DOCUMENTS

| | | | | | |
|---|---|---|---|---|---|
| 2,323,001 | A | * | 6/1943 | Bargeboer | 239/596 |
| 3,045,932 | A | * | 7/1962 | Steinen | 239/596 |
| 3,477,647 | A | * | 11/1969 | Grundman et al. | 239/596 |
| 3,669,419 | A | * | 6/1972 | Petersen et al. | 239/596 |
| 3,968,931 | A | * | 7/1976 | Smith | 239/125 |
| 4,815,966 | A | * | 3/1989 | Janssen | 431/174 |
| 4,819,878 | A | * | 4/1989 | Bailey et al. | 239/427 |
| 5,169,304 | A | | 12/1992 | Flament et al. | |
| 5,562,437 | A | | 10/1996 | Gauthier et al. | |
| 5,622,489 | A | | 4/1997 | Monro | |
| 5,863,195 | A | * | 1/1999 | Feldermann | 431/181 |
| 6,059,566 | A | * | 5/2000 | Cummings, III | 431/350 |

FOREIGN PATENT DOCUMENTS

| | | | |
|---|---|---|---|
| EP | 0 435 735 A1 | | 12/1990 |
| EP | 0 744 620 A1 | | 5/1997 |
| FR | 1 305 391 | | 8/1962 |
| FR | 2 641 365 | | 12/1988 |
| FR | 2 766 577 | | 7/1997 |
| JP | 10-311511 A | * | 11/1998 |

OTHER PUBLICATIONS

Annex to Preliminary Search Report dated Jan. 25, 2000, in French.

* cited by examiner

*Primary Examiner*—Henry Bennett
*Assistant Examiner*—Josiah C. Cocks
(74) *Attorney, Agent, or Firm*—Cohen, Pontani, Lieberman & Pavane

(57) ABSTRACT

The invention relates to liquid fuel burners having low $NO_x$ and dust emission, and it also relates to liquid atomizers or sprayers for such burners. The removable atomizer for a liquid fuel burner head is made as a single piece, has a longitudinal central orifice for passing fuel plus a plurality of longitudinal peripheral orifices for passing a spray fluid, and on each of its faces it further includes a depression surrounding said central orifice.

23 Claims, 7 Drawing Sheets

LIQUID FUEL BURNER AND ATOMIZER HAVING LOW EMISSIONS OF $NO_X$ AND DUST

The present invention relates to liquid fuel burners having low emission of $NO_x$ and of dust, and also to liquid atomizers (or spray nozzles) for such burners.

FIELD OF THE INVENTION

The technical field of the invention is that of manufacturing industrial burners of liquid fuel (in particular fuel-oil).

BACKGROUND OF THE INVENTION

Recent developments in liquid fuel burners have sought to reduce polluting emissions (un-burned solids containing carbon, CO, $NO_x$, $O_2$ involved in forming $SO_3$), while maintaining the operating performance of boilers, hot gas generators, and incinerators, and in particular while maintaining the radiation from flames in the hearth, the dimensions of hearths (and thus flame dimensions), the ability to accommodate possible variations in load, and the absence of deposits of coke or scale on the tubes of the hearth, on the stabilizer of the burner, or on its refractory door.

A technique known as flue gas recirculation (FGR) consists in recirculating (or "recycling") flue gases having a low $O_2$ content in the combustion air of burners, with the effects firstly of reducing the concentration of $O_2$ in the oxygen carrier so as to decrease "combustible" $NO_x$, and secondly of reducing the combustion temperature so as to reduce "thermal" $NO_x$ that is formed by oxidizing the nitrogen in the oxygen carrier (where such formation is highly temperature sensitive). That technique has its limits: in particular it slows down the combustion process and consequently often leads to an unacceptable increase in flame length, and also to a large increase in the emission of unburned carbon-containing solids, and also of CO and of unburned hydrocarbons.

A technique sometimes known as over firing air (OFA) ports consists in spreading out combustion as a whole by causing the burners to operate with too little air, and then adding air via ports further downstream in the flue gas circuit. That technique also has its limits: the quality of the mixing obtained between air and the combustion gas with such a method is poor, given that the air injected through the walls of the hearth cannot mix homogenously throughout the entire combustion gas stream, and as a result performance is unsatisfactory in terms of unburned solids and gases since mixing is poorly organized. It would be preferable to organize such mixing at each injection of fuel, i.e. at each burner.

Finally, a technique known as "reburning" consists in injecting fuel, often a gaseous fuel, at the end of the hearth to reduce $NO_x$ to N, and then to add combustion air for that fuel at a subsequent stage. That technique is expensive and complicated and in any event gives a better final result when the $NO_x$ has already been kept to a minimum at each burner.

Consequently, it is still necessary, even when using the FGR technique, OFA port spreading, or reburning, to keep down emissions of $NO_x$ while maintaining emissions of unburned solids or gases and of $O_2$ that are as low as possible at each burner. It is advantageous to keep down pollutant emission from the beginning of combustion, i.e. at the nozzle-carrying heads even if additional methods are also used for reducing emissions overall.

Studies performed on reducing $NO_x$ at burners (without significantly increasing unburned content) have shown that it is advantageous to cause flames to split up into a plurality of individual flames so as to cause $NO_x$ emission to drop by various effects as described in EP 0 435 735 (IFP-Pillard), which corresponds to U.S. Pat. No. 5,169,304.

The advantage of increasing flame separation while shortening each individual flame by staged injection of air directed exactly on each individual flame has been demonstrated, since it makes it possible to maintain flame diameters and lengths unchanged and to further improve performance in terms of unburned content and in reduction of $NO_x$, as described in patent U.S. Pat. No. 5,562,437 (Pillard).

Those improvements do not eliminate the need to improve atomizing (or spraying) of liquid fuels by using an auxiliary atomizing fluid (saturated or superheated steam, compressed air, compressed gas).

To this end, patent FR 2 641 365 proposes a burner having a primary spray piece which defines an axial mixing chamber into which the liquid fuel is introduced axially and into which an auxiliary fluid under pressure is introduced radially or tangentially. The chamber has primary spray nozzles each having an outlet orifice from which a jet of fuel spray issues. The burner also has a secondary spray piece which surrounds the primary spray piece and co-operates therewith to define an auxiliary chamber. The secondary spray piece carries a plurality of secondary nozzles, each of which is coaxial with a primary nozzle and has a diameter greater than the outlet orifice of the primary nozzle. The burner has means for injecting an auxiliary fluid radially into the auxiliary chamber at a pressure which is sufficient to enable it to expand in the secondary nozzle around the jets issuing from the primary nozzles, and to do so at an axial speed that is greater than the speed of the peripheral layers of the sprayed fuel jets.

In addition to its primary and secondary nozzle-carrying pieces, the burner head (or end) described in that document also includes a plurality of removable pieces disposed between the nozzle-carrying pieces and the burner body. An emulsifier defines a mixing chamber for the fuel and the auxiliary fluid and has passages (for the auxiliary fluid) fitted with fins, and also has a diaphragm (or pellet) fitted with a calibrated central orifice for introducing the fuel into the mixing chamber, and a fuel guide piece (sometimes referred to as an "atomizer") upstream from the diaphragm. Those various pieces are generally in the form of thick disks and they are "stacked" face to face and secured to the burner head by a cap which surrounds them, which is screwed onto the burner head, and which has a shoulder bearing against the periphery of the nozzle-carrying spray piece.

OBJECTS AND BRIEF SUMMARY OF THE INVENTION

An object of the present invention is to propose improved burners, in particular burners of the kind described in patent FR 2 766 557 (Pillard).

The invention seeks to simplify the implementation of liquid fuel atomizers, and in particular those described in patents FR 1 305 391 and FR 2 641 365, while leaving their functions unchanged and providing performance that is at least as good.

The invention seeks; to optimize the atomizer/burner "pair" by improvements relating specifically to the design of atomizers and dismountable liquid fuel atomizing heads, and also concerning the burner bodies proper, so as to make it easy to control optimization of this "pair".

To this end, in a first aspect, the invention consists in providing a nozzle-carrier piece suitable for being removably mounted on an atomizer head of a liquid fuel burner, the piece including a rotary link member for constraining it to turn with said head, which member is preferably integrated in the structure of the nozzle-carrier piece to increase the strength of the link and avoid any faulty relative positioning, in particular during repeated disassembly and reassembly operations for maintenance purposes.

By means of this rotary constraint, the angle of orientation about the axis of the burner of the liquid fuel jets produced by the nozzle-carrier piece can be adjusted to correspond exactly to the angular position of the secondary air injection nozzles. Specifically with the burners shown in FIG. 2 of patents EP 0 774 620 and U.S. Pat. No. 5,562,437, this makes it possible to adjust and control the angular offset that exists between the liquid fuel injection orifice and the position of the secondary nozzle, which depends on,the direction of the "rotation" imparted by the burner to the combustion air. The invention thus makes it possible to control the angular position of the piece in which the liquid fuel outlet orifices are made in such a manner that the angle of orientation of the liquid fuel injection head can be adjusted accurately on a case-by-case basis to optimize combustion.

In a preferred embodiment of the nozzle-carrier piece, it comprises a cylindrical wall of circular section (a hollow tube) which defines a cylindrical cavity, which is extended and/or partially closed at a first end by a thick transverse web (or wall) in which orifices are made to form the fuel spray nozzles, and which is open at its second end. This end is provided with a notch (or cutout) extending over a portion of its circumference, e.g. half its circumference. This end portion thus forms the rotary link member by engaging with little clearance in a cavity or depression of complementary shape formed at the end of the head which receives said removable nozzle-carrier piece.

Said cavity defined by the cylindrical body of the nozzle-carrier piece serves to receive the other pieces removably mounted on the head of the burner which serves to form a fuel jet, to mix it with the auxiliary fluid, and to transport and guide the fluid and the fuel to the nozzles.

As described in patent FR 2 641 365, the nozzle-carrier piece and the head can be releasably assembled by means of a threaded sleeve (or nut) which surrounds the nozzle-carrier piece while bearing against the periphery of its front face, which sleeve is screwed onto the threaded end of the burner head.

The end of the nozzle-carrier piece including the rotary link member preferably also includes a link member operating in longitudinal translation and suitable for co-operating with a complementary member provided at the end of the head. This disposition facilitates assembly and disassembly by enabling the nozzle-carrier piece and the removable pieces it contains to be hooked (and/or suspended) cantilevered out at the end of the head with the longitudinal axis common to the head and the nozzle-carrier piece being maintained substantially horizontal. This makes it possible to engage the sleeve around the nozzle-carrier piece without holding the piece, since it remains properly aligned with and pressed against the end of the head during this operation. The longitudinal link member is preferably integrated in the nozzle-carrier piece and is in the form of a projection such as a rib provided on the inside face of the non-cutout portion of said second end which extends over a portion of its circumference. The two integrated link members thus form a kind of hook suitable for engaging in a corresponding circumferential groove provided at the end of the head.

The advantages that result from the nozzle-carrier piece of the invention are further improved when, in a second aspect of the invention, a "compound" atomizer is used which is a single piece integrating nearly all of the functions normally provided by a plurality of pieces placed end to end ("stacked").

Thus, in another aspect, the invention consists in providing a removable atomizer for a liquid fuel spraying burner head, which atomizer has a calibrated longitudinal central orifice for passing the fuel and a plurality of longitudinal peripheral orifices for passing an auxiliary spray fluid that open out at each end in respective annular grooves provided in the two faces of the atomizer, each of said faces presenting grooves that are substantially radial. On a "rear" face, the one-piece atomizer also includes a depression surrounding said central orifice and into which tangential channels open out so that when the atomizer is mounted between the end of the head and a removable nozzle-carrier piece by a fixing member which is in the form of a sleeve, the depression co-operating with the end of the head to form an upstream chamber for swirling the fuel carried by these channels. Where appropriate, the atomizer can have a second depression suitable for co-operating with the nozzle-carrier piece to define an emulsion mixing chamber. The atomizer has radial or tangential channels on a second or "front" face that open out around the central orifice so as to enable the fuel jet leaving the central orifice to be mixed with the spray fluid.

In other words, the invention consists in proposing a single removable piece for a liquid fuel burner head, which piece has means (including tangential injection channels and a frustoconical hollow face) for guiding the flow of fuel so as to enable a conical jet to be formed at the outlet of a central orifice, means (longitudinal channels) for allowing an auxiliary fluid to pass through the piece, and means (radial or tangential channels) for guiding the fluid downstream from the central orifice and enabling the fluid to be put into contact with the jet of fuel.

Because of its small thickness, this piece is easily received inside a housing (bore) provided in the nozzle-carrier piece.

BRIEF DESCRIPTION OF THE DRAWINGS

The advantages provided by the invention will be better understood from the following description which refers to the accompanying drawings, showing preferred embodiments of the invention without the invention being limited thereto.

In the drawings, and unless stated otherwise, elements that are identical or similar are given the same references from one figure to another.

in FIG. 5 the pieces are shown assembled together while in FIG. 10 the pieces are shown separated and in alignment.

DETAILED DESCRIPTION OF THE PREFERRED EMBODIMENT

Figure 9:
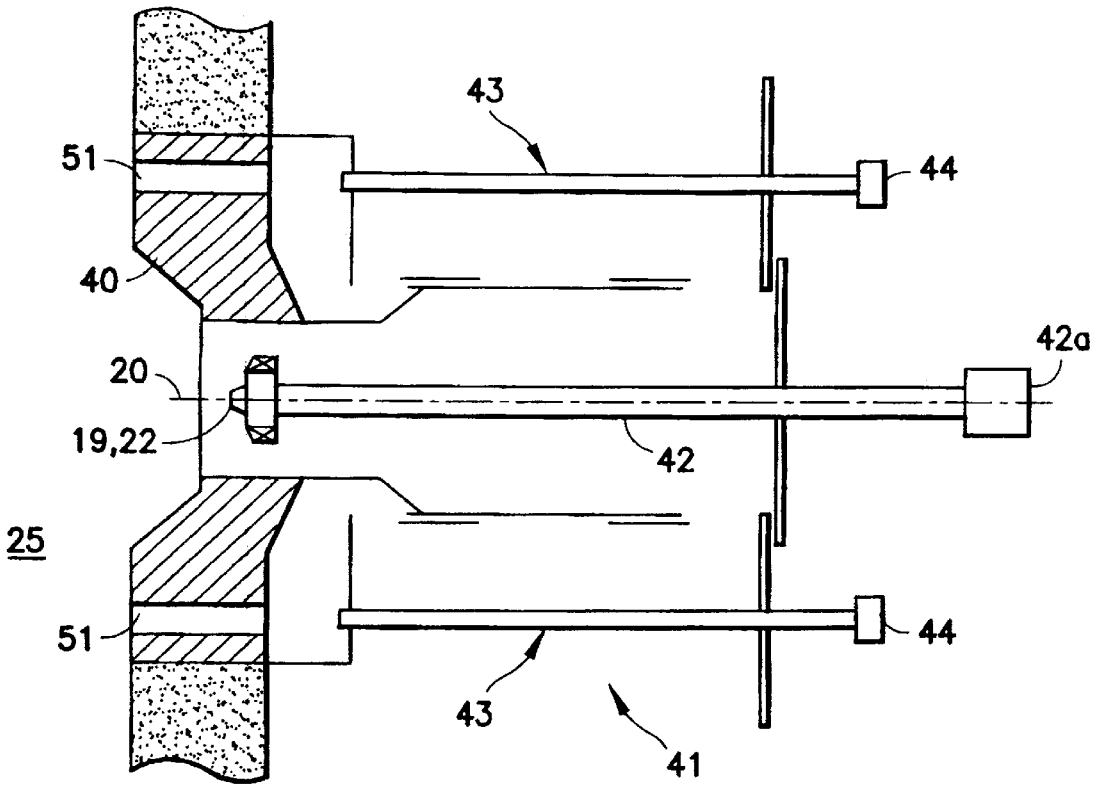
FIG. 9 is a diagrammatic longitudinal section view of a burner of the invention fitted with aiming tubes for visually inspecting the orientation of the head relative to the orifices for introducing secondary air.

The atomizer of the invention (cf. FIGS. 1 to 5) consists in a single interchangeable piece of convex cylindrical outside shape to facilitate putting it into place in a cylindrical sheath. The atomizer 1 comprises an annular inlet 14 for liquid fuel (CL) surrounded by an annular inlet 5 for auxiliary atomizing fluid (FAA) (steam, air, gas under pressure), and it comprises various devices having additional functions:

- two or more tangential paths 9 for swirling the liquid fuel setting it into rotation);
- a flat or conical wall 13 terminated by a cylindrical or conical orifice 2 of diameter that is perceptibly smaller than the outlet diameter of the tangential paths 9 opening out into a volume 21 referred to as an "emulsion chamber"; this causes the liquid fuel to leave in the form of a conical sheet under the effect of the speeds generated by the liquid pressure; and
- two or more radial or tangential paths 8 enabling the fluid FAA to be injected towards the axis 20 so that its converges with an angle $\alpha$ that preferably lies in the range 30° to 90°; the effect of these jets of FAA is to come into contact with the cone of liquid fuel and to form a mixture of FAA and liquid fuel in the volume 21 for injection into the combustion hearth via one or more orifices or nozzles 22 connecting the chamber 21 to the hearth 25 (FIG. 9).

The advantages are as follows:

- compared with heads comprising a plurality of separate pieces, a reduction in assembly errors due to pieces being assembled in the wrong order or the wrong direction; the piece 1 can be provided with an asymmetry (keying means) to prevent an operator from mounting it back to front, particularly if its front and rear faces 6 and 7 are parallel ($\alpha$=90°);
- disassembly is facilitated;
- the number of surfaces in contact is reduced to two (instead of six surfaces for three pieces), thereby reducing the number of potential leaks of liquid fuel or of FAA, and reducing to practically nil the risk of thin pieces being deformed;
- manufacturing cost is reduced since there is no longer any need to machine four contacting faces together with the necessary linking grooves;
- mistakes in selecting pieces from stocks of spare parts are reduced or eliminated; and
- the total thickness of the single piece is considerably smaller than the sum of the thicknesses of the three pieces; this saving of thickness gives rise to numerous advantages: the cylindrical sheath 23 or "assembly nut" is shorter, easier to cool, stronger, and its length that is subjected to differential expansion is shortened; the outlet piece 19 pierced by the orifices 22 is closer to the fixed piece 18 secured to the head, thereby making it possible to constrain the head 18 and the outlet piece 19 to turn together.

The removable one-piece atomizer 1 comprises (FIGS. 1 to 3) the longitudinal central orifice 2 for passing the fuel and a plurality of longitudinal peripheral orifices 3 for passing a spray fluid. In each face 6, 7 it also comprises a depression 10, 11 surrounding said central orifice, and it has a convex edge 12 enabling it to be engaged in a housing of a nozzle-carrier piece without running the risk of jamming, and also facilitating clamping thereof against the end of the head without any risk of generating mechanical stresses that could deform it, and also making it easier to press down so as to provide a leakproof connection.

The central orifice 2 is surrounded on a first face (the rear face) by a frustoconical surface 13 contributing to defining the first recess 11, the first face 7 also having an inner annular channel 14 into which the tangential channels 9 of axes 9*a* open, and having an annular rib 15 separating channel 14 from a peripheral annular channel 5 into which the longitudinal channels 3 open.

Figure 1:
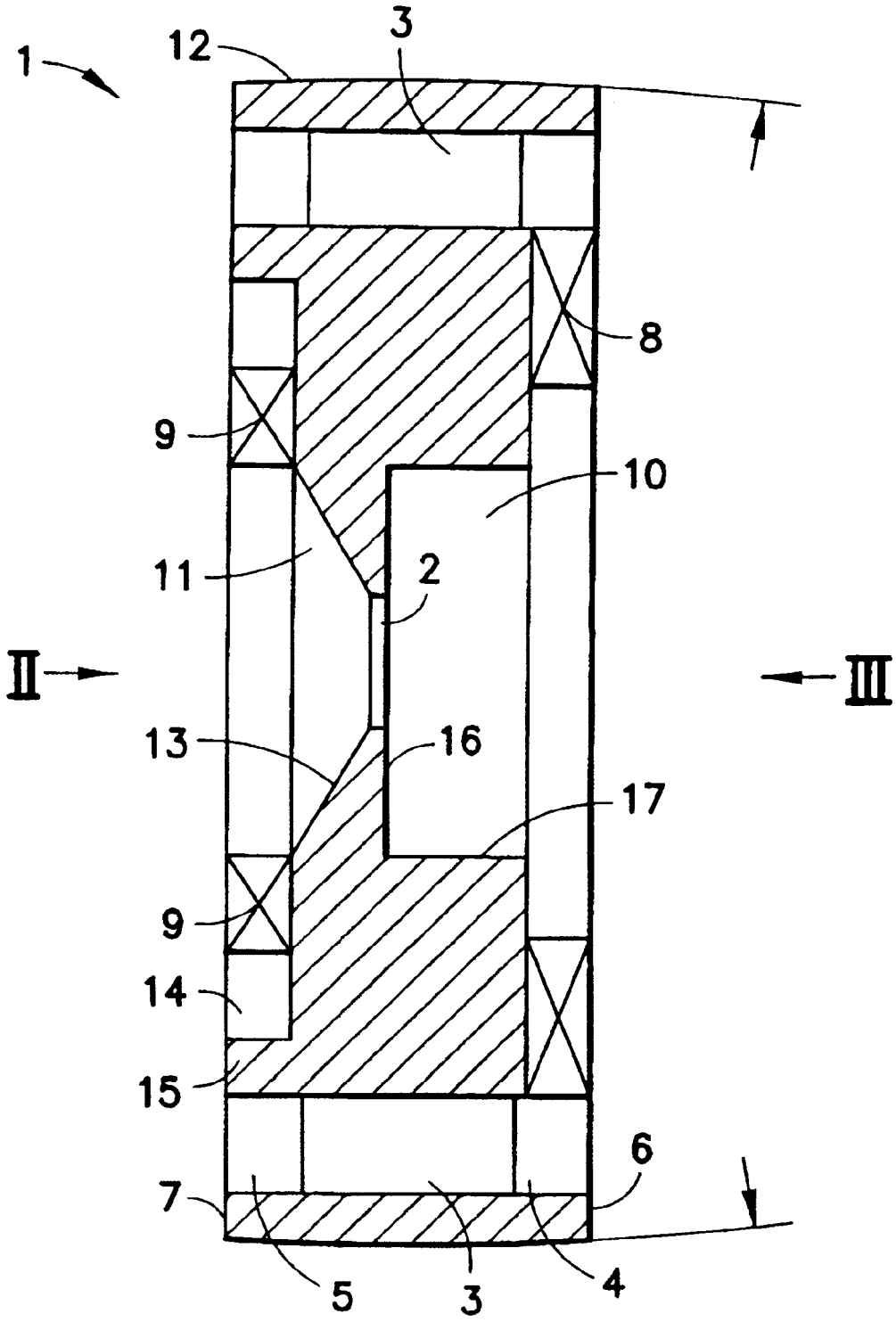
FIG. 1 is a section view on a diametral plane of an atomizer of the invention.
Figure 2:
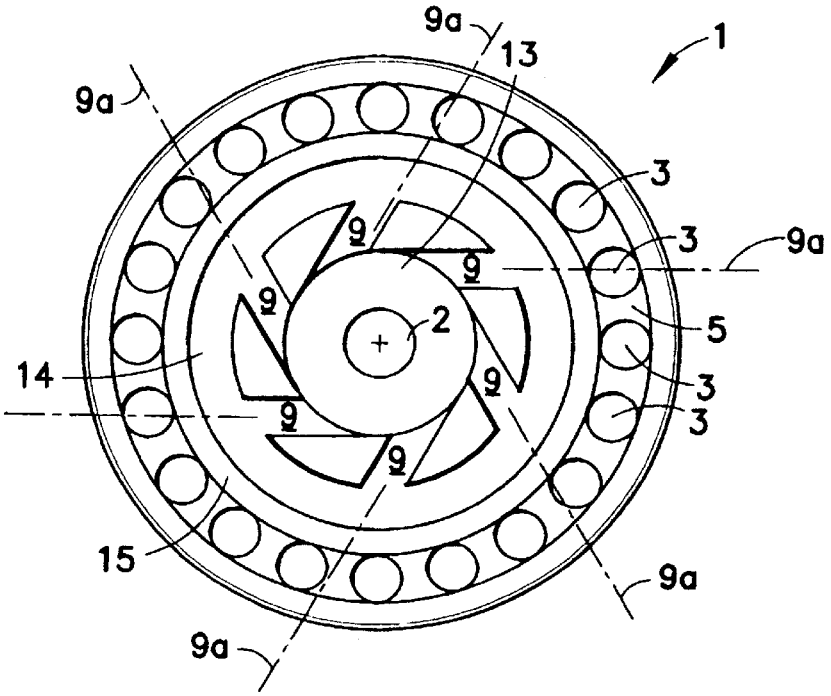
FIGS. 2 and 3 are face views of the FIG. 1 atomizer, respectively as seen looking along arrow II and III.
Figure 3:
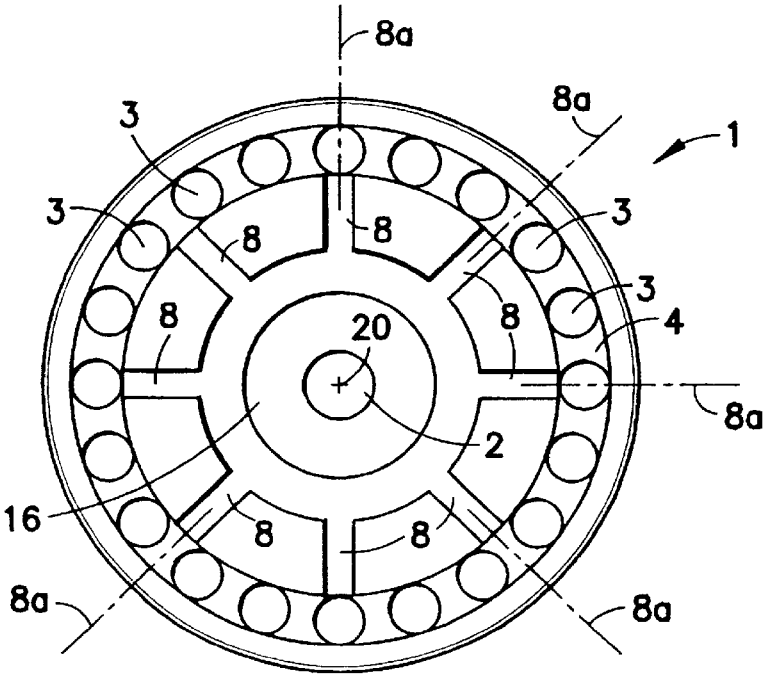
Figure 4:
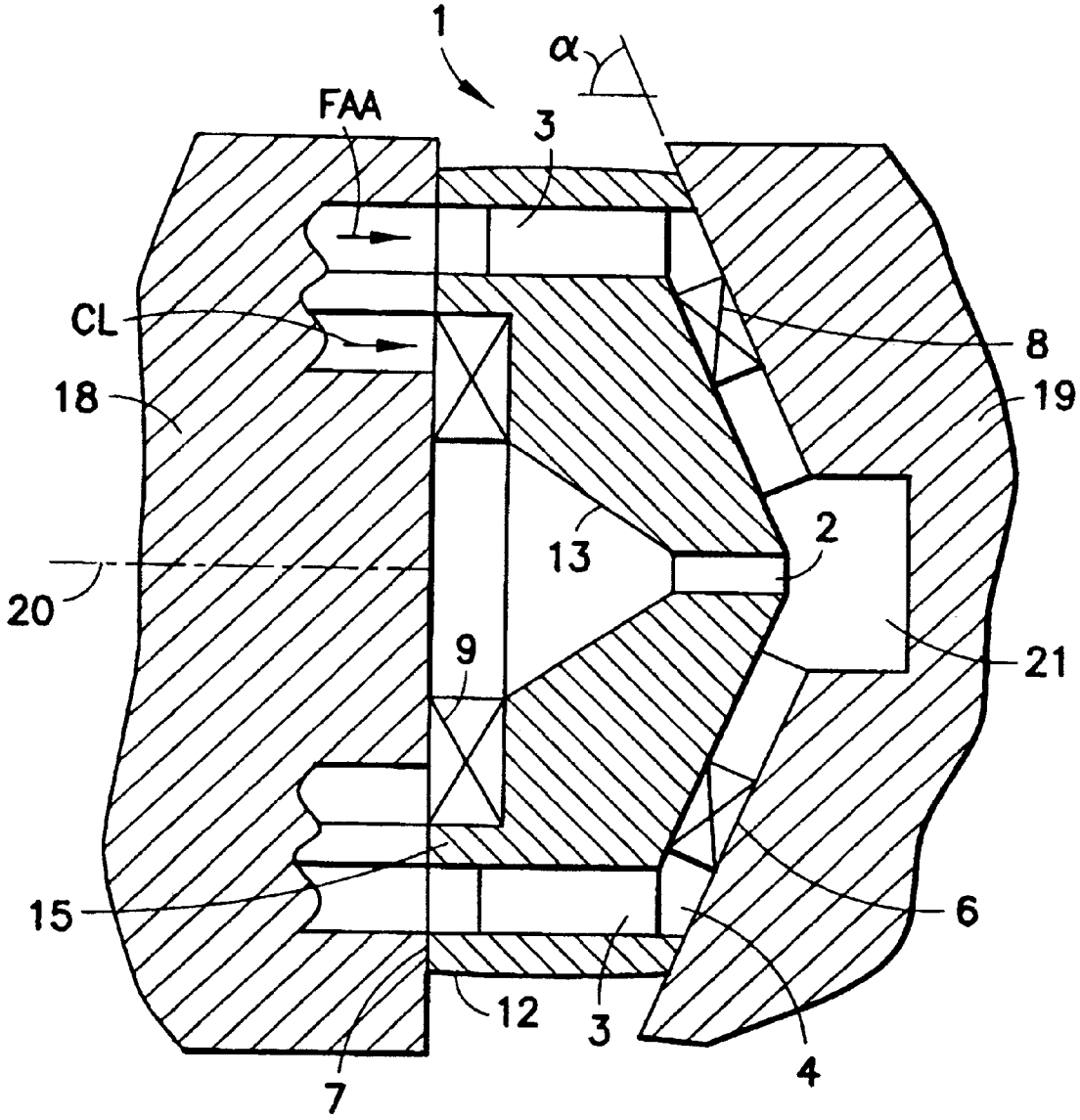
FIG. 4 is a section view on a diametral plane showing a variant embodiment of an atomizer of the invention, shown between the end of a burner head and the nozzle-carrier piece (shown in part) that surrounds it.

In the front face 6 of the atomizer, the orifice 2 is surrounded by a plane surface 16 perpendicular to the axis 20 and by a cylindrical surface 17 parallel to the axis 20, these two surfaces contributing to defining a depression 10 (FIG. 1).

In the front face 6, grooves or channels 8 of radial axis 8*a* (FIG. 3), or where appropriate of tangential axis in another configuration not shown, connect the peripheral annular channel 4, into which the longitudinal channels 3 carrying FAA open, with a central zone 10 of the face 6, where appropriate constituting a depression surrounding the orifice 2.

Figure 10:
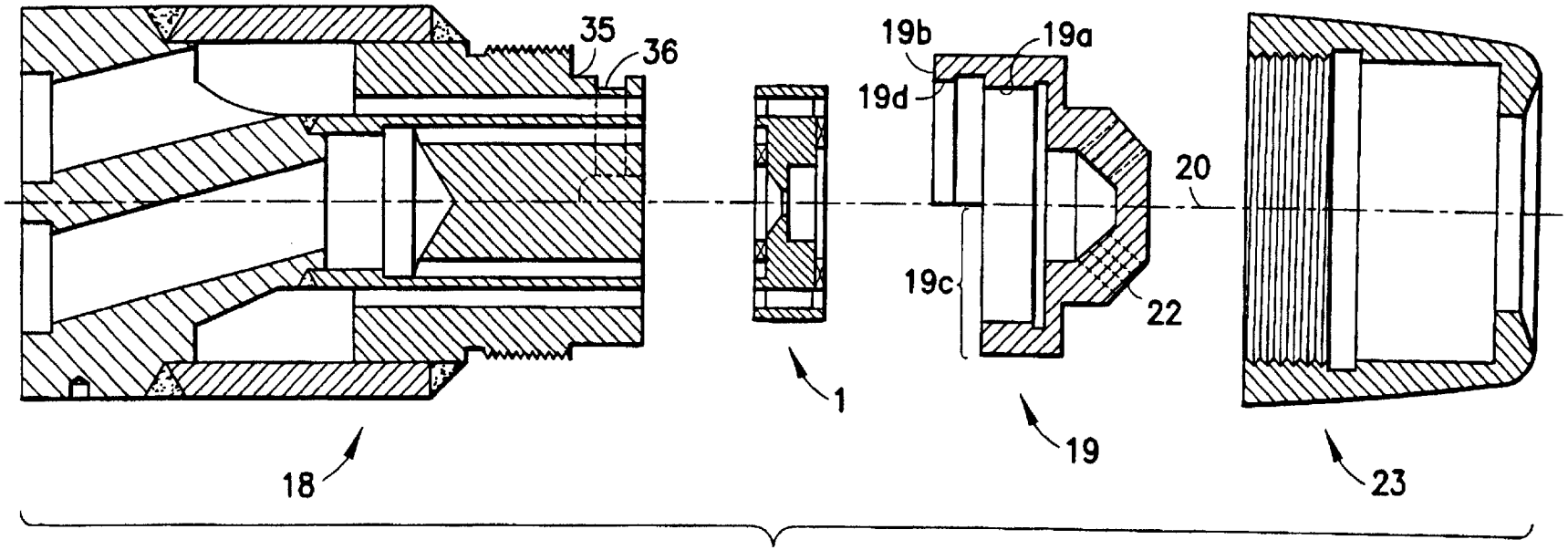

The removable nozzle-carrier piece 19 (FIGS. 5 and 10) has a plurality of spray nozzles 22 and includes a cylindrical housing 19*a* about the axis 20 suitable for receiving the atomizer 1. The piece 19 also has means for indexing it angularly relative to the burner head. For this purpose, the open end of the body is set back over a portion 19*c* of its circumference (FIG. 10) such that the end portion 19*b* is suitable for engaging in a corresponding peripheral cutout 35 provided in the end of the head 18 that is to receive the piece 19 to form an angular abutment.

The end portion has a rib 19*d* on its inside circumferential face which is suitable for engaging in a circumferential groove 36 provided at the end of the head so as to form a hook member enabling the piece to be suspended from the head before they are assembled together by a sleeve 23 surrounding the piece 19.

Figure 5:
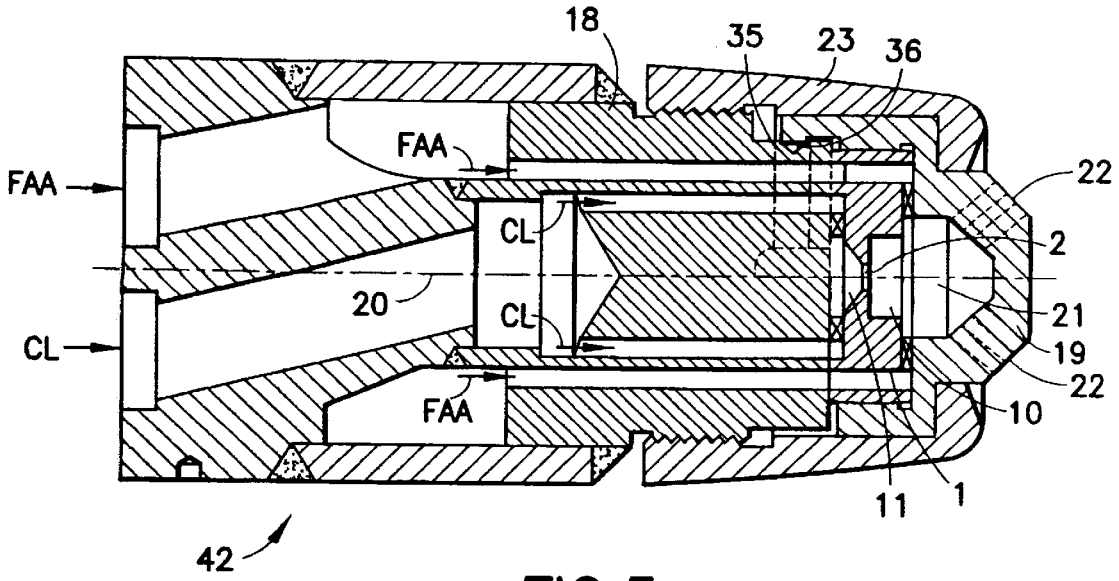
FIGS. 5 and 10 are section views on a diametral plane of the end of a head fitted with an atomizer of FIG. 1, and a nozzle-carrier piece, and a fixing sleeve.
Figure 6:
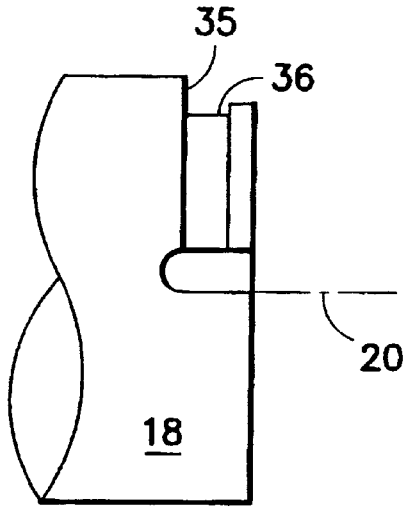
FIGS. 6 to 8 show three variant embodiments of the circumferential groove of the head for temporarily securing the nozzle-carrier piece.
Figure 7:
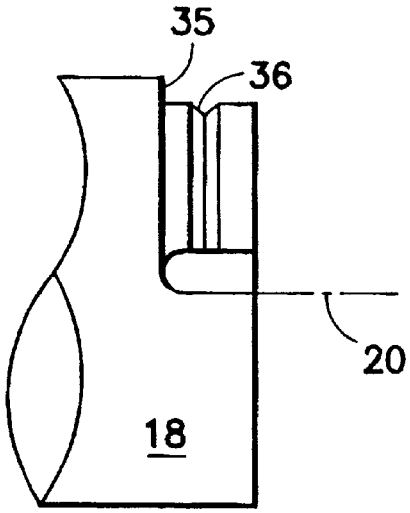
Figure 8:
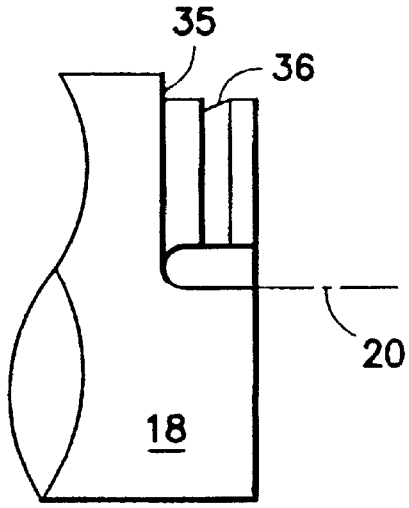

The liquid fuel burner head 42 shown in FIG. 5 has an atomizer 1 received in the longitudinal bore 19*a* provided in the nozzle-carrier piece 19; a removable sleeve 23 is screwed onto the fixed end piece 18 and surrounds and secures the nozzle-carrier piece and the atomizer to the end piece 18 of the head.

The liquid fuel burner 41 shown in FIG. 9 has a head 42 of the invention and means enabling the head to be turned relative to the door 40 about the longitudinal axis 20 of the head, which means include deformable couplings (flexible, rotary, or hinged) on the ducts for supplying fuel and auxiliary spray fluid; these means are provided at the rear portion 42*a* of the head 42.

The head extends through a door 40 and is fitted with spray nozzles 22. The burner has a plurality of air injection orifices 51 and includes means for visually inspecting the relative angular orientation of the nozzles (and/or the corresponding flame) and the orifices for injecting the oxygen carrier. These means comprise aiming tubes 43 extending parallel to the head in line with orifices 51 through the door, and fitted at their rear ends (outside the hearth) with an aiming sight 44 (or eyepiece).

What is claimed is:

1. A liquid fuel burner head comprising:

an end piece which is connected to a feed duct for fuel and to a feed duct for auxiliary spray fluid;

a single piece removable atomizer having fuel guide means for forming a jet of fuel at the outlet of a central orifice, longitudinal peripheral channels for passing said auxiliary fluid, and means for guiding said auxiliary fluid from said longitudinal channels into contact with said jet of fuel downstream of said central orifice, a removable nozzle-carrier piece having a plurality of spray nozzles downstream of said atomizer, an angular abutment for limiting rotation of said carrier piece with respect to said end piece so that the angular position of the carrier piece with respect to the end piece can be controlled; and a removable sleeve surrounding said nozzle-carrier piece and the atomizer and serving to fix them to said end piece.

2. A liquid fuel burner head according to claim 1, wherein said nozzle-carrier piece has a housing receiving said atomizer.

3. A liquid fuel burner head according to claim 1, wherein said nozzle-carrier piece has a hook member enabling said nozzle-carrier piece to be suspended from said end piece before they are assembled together by said sleeve.

4. A liquid fuel burner head according to claim 1, wherein said nozzle-carrier piece has a body having an end that includes a cutout over a portion of its circumference, which end is suitable for engaging in a peripheral cutout of complementary shape provided at the end of said end piece that is to receive said nozzle-carrier piece, thereby forming said angular abutment.

5. A burner head according to claim 4, wherein said angular abutment comprises a hook member for constraining longitudinal translation and suitable for co-operating with a complementary member provided on said end piece, said hook member enabling said nozzle-carrier piece to be suspended from said end piece before they are assembled together by said sleeve.

6. A liquid fuel burner head according to claim 3, wherein said nozzle-carrier piece comprises an end portion having a rib on an inside circumferential face, which rib is suitable for engaging in a circumferential groove provided at the end of said end piece to form said hook member.

7. A liquid fuel burner head according to claim 6, in which said nozzle-carrier piece includes a housing receiving said atomizer.

8. A liquid fuel burner including a head according to claim 1, and further including means enabling the head to turn relative to a door, and ducts for feeding said head with fuel and with auxiliary spray fluid.

9. A liquid fuel burner according to claim 8, wherein said head extends through said door the burner being fitted with spray nozzles and having a plurality of orifices for injecting oxygen carrier around the head, which burner further includes visual inspection means for verifying the relative angular orientation of the oxygen carrier injection orifices and the nozzles and/or the corresponding flames.

10. A burner according to claim 9, in which the visual inspection means comprise an aiming tube extending parallel to the head through the door.

11. A liquid fuel burner head comprising an end piece which is connectable to a feed duct for fuel and to a feed duct for auxiliary spray fluid;

a single piece removable atomizer comprising a first face, a second face, and fuel guide means for forming a jet of fuel at the outlet of a central orifice located between said faces, said first face having a recess comprising a frustoconical surface surrounding said central orifice, an inner annular channel surrounding said recess, a plurality of tangential channels for feeding fuel from said inner annular channel to said recess, and a peripheral annular channel separated from said inner annular channel by an annular rib, said second face comprising a central recess into which said central orifice opens, a peripheral annular channel, and a plurality of channels for passing said auxiliary fluid from said peripheral annular channel to said central recess, said peripheral annular channel on said second face being connected to said peripheral annular channel on said first face by a plurality of longitudinal channels, a removable nozzle carrier piece having a plurality of spray nozzles downstream of said atomizer, and an angular abutment for limiting rotation of said carrier piece with respect to said end piece, and a removable sleeve surrounding said nozzle carrier piece and said atomizer and serving to fix them to said end piece.

12. A liquid fuel burner head according to claim 11 wherein said plurality of channels on said second face extend one of radially and tangentially between said peripheral annular channel on said second face and said central recess on said second face.

13. A liquid fuel burner head according to claim 11, wherein said nozzle-carrier piece has a housing receiving said atomizer.

14. A liquid fuel burner head according to claim 11, wherein said nozzle-carrier piece has a hook member enabling said nozzle-carrier piece to be suspended from said end piece before they are assembled together by said sleeve.

15. A liquid fuel burner head according to claim 11, wherein said nozzle-carrier piece has a body having an end that includes a cutout over a portion of its circumference, which end is suitable for engaging in a peripheral cutout of complementary shape provided at the end of said end piece that is to receive said nozzle-carrier piece, thereby forming said angular abutment.

16. A liquid fuel burner head according to claim 15, wherein said angular abutment comprises a hook member for constraining longitudinal translation and suitable for co-operating with a complementary member provided on said end piece, said hook member enabling said nozzle-carrier piece to be suspended from said end piece before they are assembled together by said sleeve.

17. A liquid fuel burner head according to claim 14, wherein said nozzle-carrier piece comprises an end portion having a rib on an inside circumferential face, which rib is suitable for engaging in a circumferential groove provided at the end of said end piece to form said hook member.

18. A liquid fuel burner head according to claim 17, in which said nozzle-carrier piece includes a housing receiving said atomizer.

19. A liquid fuel burner head comprising:

an end piece which is connected to a feed duct for fuel and to a feed duct for auxiliary spray fluid;

a single piece removable atomizer having fuel guide means for forming a jet of fuel at the outlet of a central orifice, longitudinal peripheral channels for passing said auxiliary fluid, and means for guiding said auxiliary fluid from said longitudinal channels into contact with said jet of fuel downstream of said central orifice, a removable nozzle-carrier piece having a plurality of spray nozzles downstream of said atomizer, an angular abutment to limiting rotation of said carrier piece with respect to said end piece, and a hook member enabling said nozzle carrier piece to be suspended from said end piece before they are assembled together, and a removable sleeve surrounding said nozzle-carrier piece and the atomizer and serving to fix them to said end piece.

20. A liquid fuel burner head according to claim 19, wherein said nozzle-carrier piece has a housing receiving said atomizer.

21. A liquid fuel burner head according to claim 19, wherein said nozzle-carrier piece has a body having an end that includes a cutout over a portion of its circumference, which end is suitable for engaging in a peripheral cutout of complementary shape provided at the end of said end piece that is to receive said nozzle-carrier piece, thereby forming said angular abutment.

22. A liquid fuel burner head according to claim 19, wherein said hook member is formed on said angular abutment.

23. A liquid fuel burner head according to claim 19, wherein said nozzle-carrier piece comprises an end portion having a rib on an inside circumferential face, which rib is suitable for engaging in a circumferential groove provided at the end of said end piece to form said hook member.

* * * * *